US006415753B1

(12) United States Patent
Nagaosa et al.

(10) Patent No.: US 6,415,753 B1
(45) Date of Patent: Jul. 9, 2002

(54) VARIABLE VALVE APPARATUS OF INTERNAL COMBUSTION ENGINE AND METHOD OF VARYING THE OPEN-CLOSE CHARACTERISTIC OF AN ENGINE VALVE

(75) Inventors: Hideo Nagaosa, Nishikamo-gun; Yoshihiko Masuda, Okazaki; Yoshihito Moriya; Shuuji Nakano, both of Nagoya; Shinichiro Kikuoka, Nishikamo-gun, all of (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/634,882

(22) Filed: Aug. 7, 2000

(30) Foreign Application Priority Data

Aug. 24, 1999 (JP) ..... 11-237511

(51) Int. Cl.[7] ..... F01L 1/34

(52) U.S. Cl. ..... 123/90.18; 123/90.15; 123/90.19; 123/90.31

(58) Field of Search ..... 123/90.18, 90.12, 123/90.15, 90.17, 90.19, 90.31; 74/568 R; 73/116, 117.2

(56) References Cited

U.S. PATENT DOCUMENTS 5,048,474 A * 9/1991 Matayoshi ..... 123/90.18
5,381,764 A * 1/1995 Fukuma ..... 123/90.17
5,924,397 A 7/1999 Moriya et al.
6,135,078 A * 10/2000 Doi ..... 123/90.18

FOREIGN PATENT DOCUMENTS

JP A 4-187807 7/1992

* cited by examiner

*Primary Examiner*—Thomas Denion
*Assistant Examiner*—Jaime Corrigan
(74) *Attorney, Agent, or Firm*—Oliff & Berridge, PLC

(57) ABSTRACT

A variable valve apparatus of an internal combustion engine is capable of realizing more precise valve characteristic control by reducing the error in-detection of the amount of movement of a camshaft caused by a difference in the rate of thermal expansion. The variable valve apparatus has a camshaft that is supported so as to be rotatable and slidable in a direction of an axis thereof and that has three-dimensional cams whose cam profile continuously changes in the direction of the axis. The apparatus also has an actuator for moving the camshaft in the direction of its axis. The apparatus further has a camshaft position sensor provided in a cylinder head, a detected portion provided in the camshaft, and a camshaft movement amount detection portion for detecting the amount of movement of the camshaft in the direction of the axis. The camshaft movement amount detection portion is provided near a camshaft reference position.

9 Claims, 4 Drawing Sheets

VARIABLE VALVE APPARATUS OF INTERNAL COMBUSTION ENGINE AND METHOD OF VARYING THE OPEN-CLOSE CHARACTERISTIC OF AN ENGINE VALVE

INCORPORATION BY REFERENCE

The disclosure of Japanese Patent Application No. 11-237511 filed on Aug. 24, 1999 including the specification, drawings and abstract is incorporated herein by reference in its entirety.

BACKGROUND OF THE INVENTION

1. Field of Invention

The invention relates to a variable valve apparatus of an internal combustion engine that varies the open-close characteristic of an engine valve by moving a three-dimensional cam in the direction of an axis of the cam, the cam having a cam profile that continuously changes in the direction of the cam axis and a method of varying the open-close characteristic of an engine valve.

2. Description of Related Art

A known variable valve apparatus of an internal combustion engine employing a three-dimensional cam is described in, for example, U.S. Pat. No. 5,924,397. A construction of a detection portion provided in the apparatus for detecting the amount of movement of the camshaft in a direction of an axis thereof is illustrated in FIGS. 5A and 5B. FIG. 5A is a view of the detection portion taken in a direction of the axis of the camshaft. FIG. 5B is a side view of the detection portion taken in a direction indicated by an arrow B in FIG. 5A.

As shown in FIGS. 5A and 5B, an engine camshaft 22 provided with a three-dimensional cam has a pair of detected portions 74 for reference extending linearly in the direction of the axis of the camshaft 22, and a movement amount detected portion 75 for amount of movement extending helically in the direction of the axis. An electromagnetic pickup 76 that generates pulses corresponding to passage of the detected portions 74, 75 is secured to a body of the engine (cylinder head) in the vicinity of the camshaft 22. When the camshaft 22, which is rotated in a direction C in the drawings, is moved in either direction of the axis (leftward or rightward in FIG. 5B), the generation timing of pulses generated by the electromagnetic pickup 76 corresponding to the reference detected portions 74 does not change whereas the generation timing of pulses corresponding to the movement amount detected portion 75 changes. Based on these pulse generation timings, the apparatus accurately detects the amount of movement of the cam (three-dimensional cam). Therefore, precise cam position control (i.e., precise valve characteristic control) can be performed.

In variable valve apparatus employing three-dimensional cams, it is a normal practice to set a camshaft reference position as a positioning reference in the direction of the axis of a camshaft for mounting the camshaft to a cylinder head, or as a detection reference for detecting the amount of movement of the camshaft during operation. This camshaft reference position is also referred to when the electromagnetic pickup 76 and other members are secured to predetermined positions on the cylinder head.

If a base member (cylinder head) to which the electromagnetic pickup 76 is secured and the camshaft where the movement amount detected portion 75 and the like are provided are made of different materials; for example, the cylinder head is formed as a cast aluminum alloy and the camshaft is formed from iron, an increase in the engine temperature causes, in some cases, a positional deviation due to the different rates of thermal expansion of the materials. In such a case, the precision in detecting the amount of movement of the camshaft may decrease, and the control precision related to the valve characteristics determined by the three-dimensional cam, such as the valve-opening angle and the valve lift, may also decrease.

More specifically, even if, during the assembly of the engine, the position of the electromagnetic pickup 76 and the positions of the reference detected portions 74 and the movement amount detected portion 75 are initially adjusted (initialized) based on the camshaft reference position, and the reference position regarding the detection of the amount of movement of the camshaft is initialized, it is difficult to prevent the initialized positions from deviating with increases in the engine temperature, due to different rates of thermal expansion. If detection related to the amount of movement of the camshaft is performed while such a positional deviation exists, there is a possibility that precise control of the valve characteristics through the use of the three-dimensional cam becomes difficult. This possibility is particularly great if the deviation is great.

SUMMARY OF THE INVENTION

Accordingly, a variable valve apparatus of an internal combustion engine according to various exemplary embodiments of the invention is capable of realizing more precise valve characteristic control by reducing the error in detection of the amount of movement of a camshaft caused by a difference in the rate of thermal expansion.

The variable valve apparatus of an internal combustion engine for varying an open-close characteristic of an engine valve according to various exemplary embodiments of the invention includes a camshaft that has a plurality of three-dimensional cams whose cam profile continuously changes in a direction of a cam axis and that is supported so as to be rotatable and slidable in the direction of the cam axis relative to a body of the internal combustion engine. The apparatus also includes a movement mechanism that moves the camshaft in a direction of an axis of the camshaft, a camshaft position marker provided in the camshaft, and a camshaft movement amount detector that is provided in the body of the internal combustion engine and that detects the camshaft position marker and detects an amount of movement of the camshaft in the direction of the axis of the camshaft. The camshaft position marker and the camshaft movement amount detector are provided near a reference position that is provided at a predetermined position in a direction of a length of the camshaft.

Therefore, even if the engine body, where the camshaft movement amount detector is provided, and the camshaft, where the camshaft position marker is provided, are made of different materials and therefore have different rates of thermal expansion, the variable valve apparatus is able to reduce the error in detection of the amount of movement of the camshaft caused by the different rates of thermal expansion.

In the variable valve apparatus according to various exemplary embodiments of the invention, the reference position may be provided near a central portion of the camshaft.

The provision of the camshaft movement amount detector near a central portion of the camshaft reduces the distance from the movement amount detector to a farthest three-dimensional cam. Therefore, it becomes possible to reduce the deviation from the initialized position of the movement amount detection means, the deviation being caused by thermal expansion of the camshaft, and to reduce the variation in the amounts of control achieved by the three-dimensional cams in the valve characteristic control.

BRIEF DESCRIPTION OF THE DRAWINGS

Various exemplary embodiments of the invention will be described with reference to the accompanying drawings, wherein like numerals are used to represent like elements and wherein.

DETAILED DESCRIPTION OF PREFERRED EMBODIMENTS

Various exemplary embodiments of the variable valve apparatus according to the invention will be described hereinafter with reference to the accompanying drawings.

Figure 1:
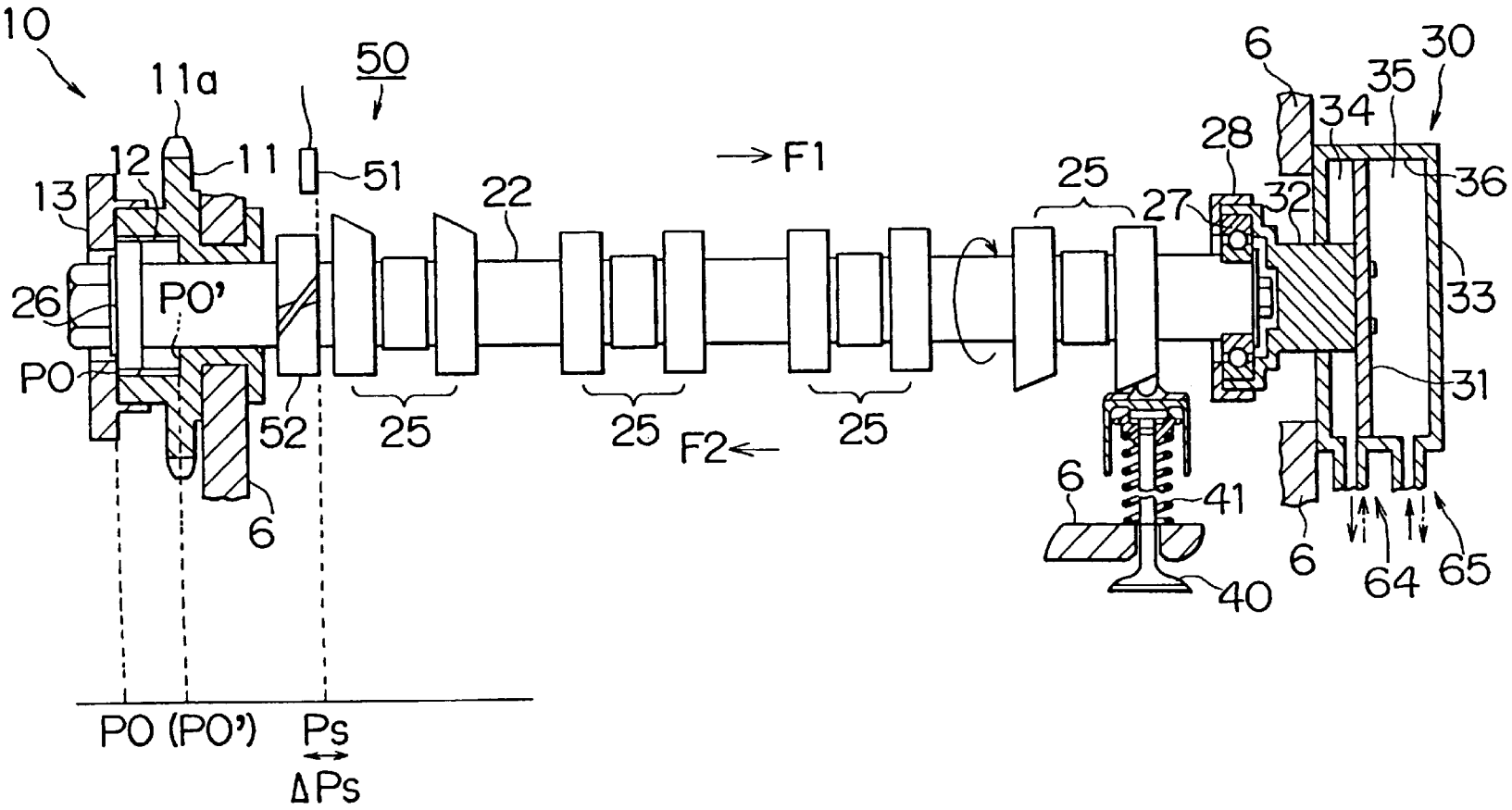
FIG. 1 is an illustration of a construction of a first embodiment of the variable valve apparatus according to the invention.

FIG. 1 is a partial sectional side view of a construction of a first embodiment of the invention. A variable valve apparatus of the embodiment includes a camshaft 22 provided with three-dimensional cams 25 and a spline gear 26, a hydraulic actuator 30 for moving the camshaft 22 in the directions of the camshaft axis, and a movement amount detection portion 50 for detecting the amount of movement of the camshaft 22.

The camshaft 22 is supported by a bearing portion of a cylinder head 6 that forms an internal combustion engine body, in such a manner that the camshaft 22 is rotatable and movable in the directions of the axis of the camshaft 22. The camshaft 22 is rotated by an output shaft (not shown) of the engine. The cam profile of each three-dimensional cam 25 continuously changes in a direction of the camshaft axis from a cam profile that provides a large valve lift (or a large valve-opening angle) and that is suitable to high-speed/high-load operation of the engine to a cam profile that provides a small valve lift (or a small valve-opening angle) and that is suitable to low-speed/low-load operation (see FIG. 1). The cam profile surface of each three-dimensional cam 25 is shaped so that the amount of valve lift increases at the side of the hydraulic actuator 30 and decreases at the side of the spline gear 26. Therefore, the camshaft 22 is constantly urged in the direction indicated by arrow F2 away from the hydraulic actuator 30 toward the spline gear 26 by forces from valve springs 41 of engine valves 40 (only one engine valve is shown in FIG. 1 for clarity) that are pressed by the three-dimensional cams 25.

The engine valves 40 are driven in the opening and closing directions based on pressurization by the three-dimensional cams 25. As the camshaft 22 is slid in a direction of the camshaft axis, the cam profile of a portion of each three-dimensional cam 25 that contacts the corresponding engine valve 40 changes. Therefore, the valve characteristics of the engine valves 40, such as the valve lift and the valve-opening angle can be varied.

The spline gear 26 is bolted to a distal end of the camshaft 22 as part of a rotating mechanism 10. Due to the spline gear 26, the camshaft 22 can be rotated together with a sprocket 11 even when the camshaft 22 is slid in a direction of the camshaft axis. More specifically, the spline gear 26 is movable, that is, the camshaft 22 is movable, in the directions of the axis of the camshaft 22, along splines 12 formed in an inner peripheral surface of the sprocket 11. The sprocket 11 has, on its outer peripheral surface, outer teeth 11*a* that are engaged with a timing chain (not shown). The chain transmits torque from a crankshaft (not shown) to the sprocket 11 and the camshaft 22. The sprocket 11 is provided with a cover 13 that is a member for restricting movement of the camshaft 22 in a direction indicated by the arrow F2 in FIG. 1.

A base end portion of the camshaft 22 (the right-side end portion in FIG. 1) is bolted to an inner ring of a bearing 27. An outer ring of the bearing 27 is secured to a rod 32 by a nut 28. Thus, the camshaft 22 and the rod 32 are interconnected so that the camshaft 22 and the rod 32 are rotatable relative to each other and are slidable together as one piece in the directions of the camshaft axis indicated by the arrows F1 and F2.

Figure 2:
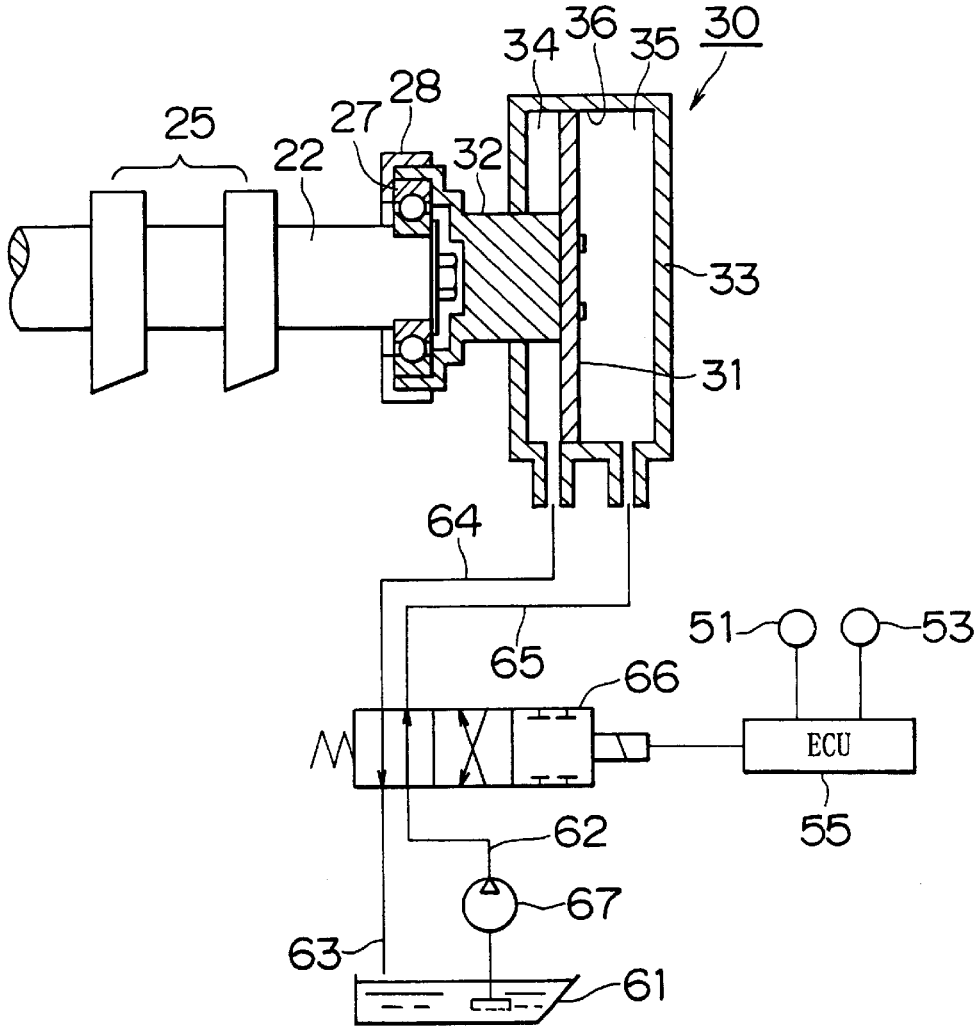
FIG. 2 is a hydraulic circuit diagram, illustrating a construction of a hydraulic actuator.

The hydraulic actuator 30 is disposed at the distal end portion of the camshaft 22 as shown in FIGS. 1 and 2. The hydraulic actuator 30 is provided for moving the camshaft 22 in the directions of the camshaft axis via the rod 32. The hydraulic actuator 30 includes a piston 31 and a case 33 secured to the cylinder head 6.

The rod 32 is secured at one end to the piston 31. The case 33 defines therein a cylindrically shaped cylinder 36. The piston 31 is housed in the cylinder 36 in such a manner that the piston 31 is slidable in the directions of the camshaft axis. Thus, the piston 31, the rod 32 and the camshaft 22 are slidable together as one piece in the directions of the camshaft axis.

The internal space of the cylinder 36 is divided into two hydraulic chambers 34, 35 by the piston 31. Operating fluid is charged into the hydraulic chambers 34, 35 to actuate the hydraulic actuator 30. Used as the operating fluid may be a portion of lubricating fluid for various portions of the engine. Fluid passages 64, 65 are connected to the hydraulic chambers 34, 35, respectively, to supply the operating fluid to and discharge it from the hydraulic chambers 34, 35. The fluid passages 64, 65 are connected at other ends thereof to a fluid pressure control valve 66 as shown in FIG. 2.

The fluid pressure control valve 66 is an electromagnetic direction changeover valve that is duty-controlled by an electronic control unit (ECU) 55. In addition to the fluid passages 64, 65, two fluid passages 62, 63 are connected to the fluid pressure control valve 66. The fluid passage 62 has in its partway a pump 67 that pumps the operating fluid from a pan 61 storing the operating fluid and that pressurizes and ejects the operating fluid. That is, the fluid passage 62 is a passage for supplying the operating fluid to the fluid pressure control valve 66. The fluid passage 63 is a passage for discharging the operating fluid into the oil 61. The fluid passages 62–65 may be formed in the cylinder head 6 or a cylinder block (not shown) that form the engine body.

The fluid pressure control valve 66 is controlled so as to selectively establish communication between the fluid passages 64, 65 connected to the hydraulic chambers 34, 35 of the hydraulic actuator 30 and the operating fluid supplying passage 62 and the operating fluid discharging passage 63 (two combinations) or to block the communication (balancing state). When the fluid pressure control valve 66 is in either one of the communicating states, the operating fluid is supplied from the pump 67 to one of the hydraulic chambers 34, 35, and is discharged from the other one of the hydraulic chambers 34, 35 to the pan 61. When the fluid pressure control valve 66 is in the blocking (balancing) state, the pressure of the operating fluid in the hydraulic chambers 34, 35 is maintained. Thus, the fluid pressure control valve 66 adjusts the pressure of the operating fluid in the hydraulic chambers 34, 35 by controlling the amounts of the operating fluid supplied and discharged.

The hydraulic actuator 30 operates based on the control of the pressure of the operating fluid in the hydraulic chambers 34, 35. For example, if the operating fluid pressure in the hydraulic chamber 34 is made higher than the pressure in the hydraulic chamber 35, the piston 31 receives a force based on the operating fluid pressure difference across the piston 31 such that the piston 31 moves together with the rod 32 and the camshaft 22 in a direction indicated by the arrow F1 in FIG. 1. As a result, the cam profile of a portion of each three-dimensional cam 25 that contacts the corresponding engine valve 40 changes to a cam profile that provides an increased valve lift (or an increased valve-opening angle). Conversely, if the operating fluid pressure in the hydraulic chamber 34 is made lower than the pressure in the hydraulic chamber 35, the piston 31 moves together with the rod 32 and the camshaft 22 in a direction indicated by the arrow F2 in FIG. 1. As a result, the cam profile of a portion of each three-dimensional cam 25 that contacts the corresponding engine valve 40 changes to a cam profile that provides a decreased valve lift (or a decreased valve-opening angle). Thus, the valve characteristics of the engine valves 40 can be changed.

Figure 3:
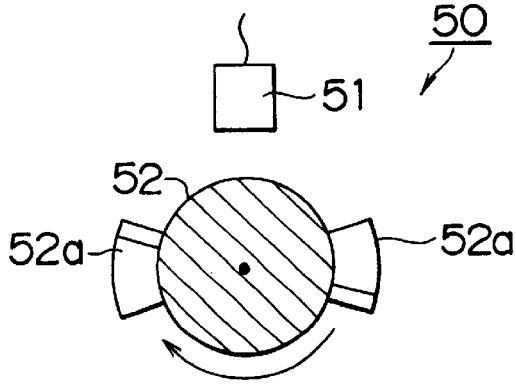
FIG. 3 is a sectional view illustrating a construction of a camshaft movement amount detection portion.

The camshaft 22 has a detected portion 52 that is used to detect the amount of movement of the camshaft 22 in the directions of the camshaft axis, at a position between the distal end (left-side end in FIG. 1) of the camshaft 22 and the three-dimensional cam 25 that is disposed nearest to the distal end among all the three-dimensional cam 25. The detected portion 52 is provided with a pair of protruded movement amount detected portions 52*a* for the amount of movement (see FIG. 3). The movement amount detected portions 52*a* are made of a magnetic material. The movement amount detected portions 52*a* extend helically in the directions of the axis of the camshaft 22. A camshaft position sensor 51 formed by an electromagnetic pickup is provided at such a position on the engine body, for example, on the cylinder head 6, that the camshaft position sensor 51 faces the detected portion 52.

Since the movement amount detected portions 52*a* extend helically in the direction of the axis of the camshaft 22, pulse signals (currents) induced in the camshaft position sensor 51 when the movement amount detected portions 52*a* pass by the sensor 51 during rotation of the camshaft 22 shift in phase relative to an output signal (reference pulse signal) from, for example, a crank angle sensor provided on a crankshaft that is an output shaft of the engine, by a shift amount corresponding to the amount of movement of the camshaft 22 in the direction of the camshaft axis. Therefore, by monitoring the phase difference between the pulse signals, the amount of movement of the camshaft 22 can be detected at any time.

Therefore, to control the valve characteristics of the engine valves 40, the operational condition of the engine is detected from output signals of various sensors 53 (FIG. 2), such as the crank angle sensor, a pressure sensor for detecting the pressure of intake air introduced into the engine, etc., and, on the basis of the operational condition, calculates a target position of the camshaft 22 in the direction of the camshaft axis at which a suitable valve characteristic will be obtained. Furthermore, the apparatus detects the actual position of the camshaft 22 in the direction of the camshaft axis by referring to the output signal of the camshaft position sensor 51 as well. Then, based on comparison between the target position and the actual position of the camshaft 22 in the direction of the camshaft axis, the ECU 55 feedback-controls the fluid pressure control valve 66.

In a conventional apparatus that changes the valve characteristics (the valve lift, the valve-opening angle, etc.) of engine valves by changing the cam profile by sliding a camshaft from the reference position in a direction of the axis of the camshaft, an error regarding the reference position of the camshaft in the direction of the cam axis will cause an error regarding the site in each three-dimensional cam where the cam contacts the corresponding engine valve, thereby making it impossible to achieve a desired valve characteristic. Therefore, during assembly and operation, the precision of the reference position of the camshaft in the direction of the cam axis is an important factor that affects the performance of the apparatus.

Therefore, the variable valve apparatus according to various exemplary embodiments of the invention secures a positional precision by setting a position where the spline gear 26 disposed at the distal end of the camshaft 22 contacts the cover 13 of the sprocket 11, as a reference position P0 of the camshaft 22 in the direction of the camshaft axis. For example, the initial positioning (initialization) of the camshaft position sensor 51 and the detected portion 52, that is, the initialization of the detection reference position Ps for detecting the amount of movement of the camshaft 22 in the direction of the cam axis, is performed based on the reference position P0 of the camshaft 22.

However, even if the detection reference position Ps is initialized based on the reference position P0, a positional deviation can occur. If the cylinder head 6 and the camshaft 22 are formed from different materials, for example, if the cylinder head 6 is formed as a cast aluminum alloy and the camshaft 22 is formed from iron, the relative positional relationship between the camshaft position sensor 51 and the detected portion 52 changes with increases in the temperature of the engine, due to the different thermal expansion rates of the materials (e.g., aluminum has a greater linear expansion rate than iron). Thus, a deviation $\alpha$Ps occurs to the initialized detection reference position Ps.

In the variable valve apparatus the embodiment shown in FIG. 1, however, the camshaft movement amount detection portion 50, having the camshaft position sensor 51 and the detected portion 52, is provided near the reference position P0 of the camshaft 22, so that the deviation $\Delta$Ps of the detection reference position Ps caused by different rates of thermal expansion as mentioned above is minimized. More specifically, with reference to the reference position P0, the positional deviation caused by the different thermal expansion rates of the cylinder head 6 and the camshaft 22 increases with increases in distance from the reference position P0. Therefore, the provision of the camshaft movement amount detection portion 50 near the reference position P0 minimizes the effect of the deviation caused by thermal expansion.

Thus, the variable valve apparatus of the embodiment shown in FIG. 1 minimizes the error deviation APs of the detection reference position Ps caused by the difference in thermal expansion between the cylinder head 6 and the camshaft 22 since the camshaft movement amount detection portion 50 is provided near the reference position P0 of the camshaft 22. Therefore, the apparatus is able to perform precise valve characteristic control with a minimized error in detection of the amount of movement of the camshaft.

Although in the foregoing embodiment, the reference position P0 of the camshaft 22 is set on the contact surface of the cover 13 that contacts the spline gear 26, that is, at a position at which the camshaft 22 is restricted from moving in the direction of the arrow F2 in FIG. 2, it should be appreciated that the reference position P0 may be set at a position where the camshaft 22 is restricted from moving in the direction of the arrow F1 in FIG. 1, as indicated by P0' in FIG. 1.

Figure 4:
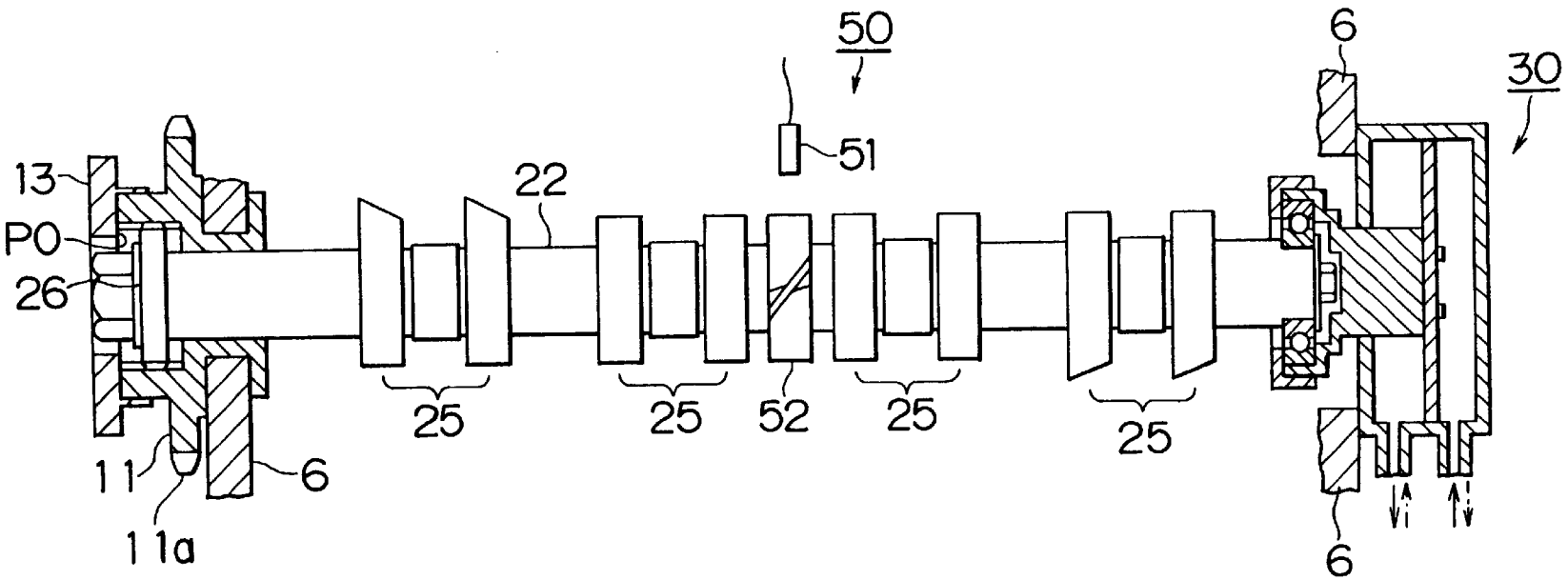
FIG. 4 is a partial sectional side view illustrating a construction of a side portion of a second embodiment of the variable valve apparatus according to the invention.
Figure 5A:
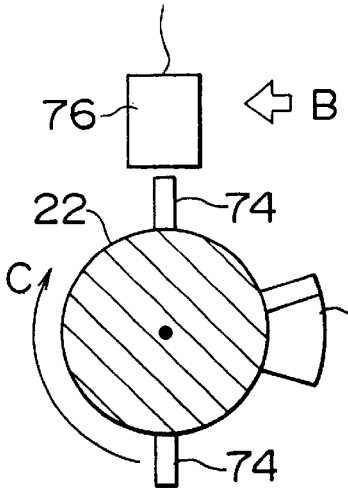
FIG. 5A RELATED ART
FIG. 5A is a sectional view illustrating a construction of a camshaft movement amount detection portion of a related-art variable valve apparatus.
Figure 5B:
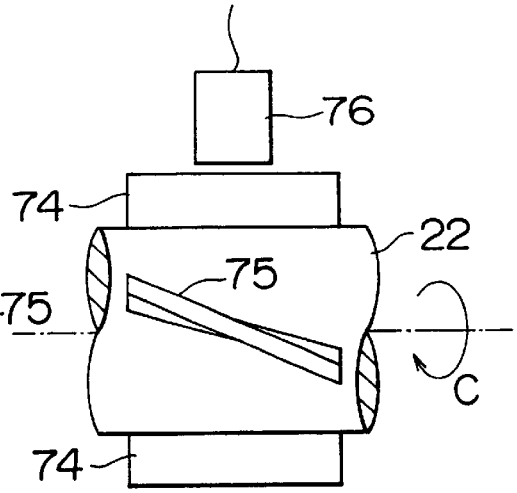
FIG. 5B RELATED ART
FIG. 5B is a side view illustrating the construction of the camshaft movement amount detection portion of FIG. 5A.

A second embodiment of the variable valve apparatus of the invention will be described with reference to FIG. 4.

The variable valve apparatus of the second embodiment differs from the variable valve apparatus of the first embodiment shown in FIG. 1 in the position of the camshaft movement amount detection portion 50. More specifically, in the variable valve apparatus of the second embodiment shown in FIG. 4, a detected portion 52 forming the camshaft movement amount detection portion 50 is provided in a central portion of the camshaft 22. A camshaft position sensor 51 is secured to a predetermined position (not shown) on a cylinder head 6 so as to face the detected portion 52.

The provision of the camshaft movement amount detection portion 50 in a central portion of the camshaft 22 reduces the distance from the detection portion 50 to a three-dimensional cam 25 that is farthest from the detection portion 50, that is, the greatest one of the distances to the three-dimensional cams 25. Therefore, even though the camshaft 22 thermally expands due to increases of in the temperature of the engine, variations in the amounts of control of the valve characteristics achieved by the three-dimensional cams 25 can be reduced. More specifically, when the camshaft 22 thermally expands as described above, the error of the detected value of the amount of movement of the camshaft 22 from the actual position of a three-dimensional cam 25 becomes greater if the cam 25 is farther from the camshaft movement amount detection portion 50. However, since the camshaft movement amount detection portion 50 is provided in a central portion of the camshaft 22, the distance from the detection portion 50 to a farthest three-dimensional cam is reduced, for example, to about half the distance to a farthest three-dimensional cam in the case where a camshaft movement amount detection portion 50 is provided at an end of the camshaft 22. Thus, the effect of thermal expansion of the camshaft 22 is significantly reduced in this embodiment.

In the second embodiment, the reference position of the camshaft 22 may also be set near the camshaft movement amount detection portion 50, that is, near a central portion of the camshaft 22. In that case, it becomes possible to reduce both the deviation from the initialized position of the movement amount detection means caused by thermal expansion of the camshaft and the variation in the amounts of control achieved by the three-dimensional cams 25 in the valve characteristic control.

In the foregoing embodiments, the actuator for moving the camshaft 22 in the directions of the axis thereof is not limited to the hydraulic actuator 30 operated based on hydraulic pressure, but may also be a different type of actuator, for example, a mechanical or a pneumatic actuator.

Furthermore, the camshaft movement amount detection portion 50 is not limited to a detection portion that includes a camshaft position sensor 51 formed by an electromagnetic pickup and a detected portion 52 having a pair of protruded movement amount detected portions 52*a* extending helically in the directions of the cam axis. For example, the camshaft position sensor may be formed by a photo-sensor or a distance sensor. The detected portion may have only one movement amount detected portion that is protruded and helically extends.

While the invention has been described with reference to exemplary embodiments thereof, it is to be understood that the invention is not limited to the disclosed embodiments or constructions. On the contrary, the invention is intended to cover various modifications and equivalent arrangements. In addition, while the various elements of the invention are shown in various combinations and configurations, which are exemplary, other combinations and configurations, including more, less or only a single embodiment, are also within the spirit and scope of the invention.

What is claimed is:

1. A variable valve apparatus of an internal combustion engine that varies an open-close characteristic of an engine valve, the apparatus comprising:

a camshaft that has a plurality of three-dimensional cams whose cam profile continuously changes in a direction of a camshaft axis and that is supported so as to be rotatable and slidable in the direction of the camshaft axis relative to a body of the internal combustion engine;

a rotating mechanism that rotates the camshaft about the camshaft axis;

a movement mechanism that moves the camshaft in the direction of the camshaft axis;

a camshaft position marker provided in the camshaft; and a camshaft movement amount detector that is provided in the body of the internal combustion engine and that detects the camshaft position marker and detects an amount of movement of the camshaft in the direction of the camshaft axis, wherein the camshaft position marker and the camshaft movement amount detector are provided at a detection reference position, the detection reference position based on a camshaft reference position that is provided at a predetermined initial position in which movement of the camshaft toward the rotating mechanism along the camshaft axis is physically restrained by the rotating mechanism, the detection reference position being established to minimize or reduce deviations in a relative axial position of the camshaft position marker and the camshaft movement amount detector due to differences in thermal expansion rates of the camshaft and the body of the internal combustion engine where the camshaft movement amount detector is provided.

2. A variable valve apparatus according to claim 1, further comprising a restrictor that is provided at a side of an end portion of the camshaft and that restricts a movement of the camshaft in the direction of the camshaft axis, wherein the movement mechanism is provided at a side of another end portion of the camshaft, and the reference position is a position at which the camshaft contacts the restrictor.

3. A variable valve apparatus according to claim 1, wherein the detection reference position is near a central portion of the camshaft.

4. A method of varying the open-close characteristic of an engine valve of a variable valve apparatus of an internal combustion engine having a camshaft that has a plurality of three-dimensional cams whose cam profile continuously changes in a direction of a camshaft axis and that is supported so as to be rotatable and slidable in the direction of the camshaft axis relative to a body of the internal combustion engine; a rotating mechanism that rotates the camshaft about the camshaft axis; a camshaft position marker provided in the camshaft; and a camshaft movement amount detector that is provided in the body of the internal combustion engine, wherein the camshaft position marker and the camshaft movement amount detector are provided at a detection reference position, the detection reference position based on a camshaft reference position that is provided at a predetermined initial position in which movement of the camshaft toward the rotating mechanism along the camshaft axis is physically restrained by the rotating mechanism, the detection reference position being established to minimize or reduce deviations in a relative axial position of the camshaft position marker and the camshaft movement amount detector due to differences in thermal expansion rates of the camshaft and the body of the internal combustion engine where the camshaft movement amount detector is provided; the method comprising:

moving the camshaft in the direction of the of the camshaft axis; and detecting the camshaft position marker and an amount of movement of the camshaft in the direction of the camshaft axis.

5. A method according to claim 4, further comprising:

providing a restrictor at a side of an end portion of the camshaft and that restricts a movement of the camshaft in the direction of the camshaft axis, wherein the reference position at which the camshaft contacts the restrictor.

6. A method according to claim 4, wherein the detection reference position is near a central portion of the camshaft.

7. A variable valve apparatus of an internal combustion engine that varies an open-close characteristic of an engine valve, the apparatus comprising:

a camshaft that has a plurality of three-dimensional cams whose cam profile continuously changes in a direction of a camshaft axis and that is supported so as to be rotatable and slidable in the direction of the camshaft axis relative to a body of the internal combustion engine;

rotating means for rotating the camshaft about the camshaft axis;

movement means for moving the camshaft in the direction of the camshaft axis;

a camshaft position marker provided in the camshaft; and camshaft movement amount detecting means provided in the body of the internal combustion engine for detecting the camshaft position marker and detecting an amount of movement of the camshaft in the direction of the camshaft axis, wherein the camshaft position marker and the camshaft movement amount detector are provided at a detection reference position, the detection reference position based on a camshaft reference position that is provided at a predetermined initial position in movement of the camshaft toward the rotating means along the camshaft axis is physically restrained by the rotating means, the detection reference position being established to minimize or reduce deviations in a relative axial position of the camshaft position marker and the camshaft movement amount detector due to differences in thermal expansion rates of the camshaft and the body of the internal combustion engine where the camshaft movement amount detector is provided.

8. A variable valve apparatus according to claim 7, further comprising a restriction member provided at a side of an end portion of the camshaft for restricting a movement of the camshaft in the direction of the camshaft axis, wherein the movement means is provided at a side of another end portion of the camshaft, and the reference position is a position at which the camshaft contacts the restriction member.

9. A variable valve apparatus according to claim 7, wherein the detection reference position is near a central portion of the camshaft.

* * * * *